US008225727B2

(12) United States Patent
Wilson et al.

(10) Patent No.: US 8,225,727 B2
(45) Date of Patent: Jul. 24, 2012

(54) TUFTING MACHINE

(75) Inventors: William Brian Wilson, Alexandria (AU); Mile Jez, Alexandria (AU); Joseph Van Woerkom, Alexandria (AU)

(73) Assignee: Wilcom Pty Ltd, Alexandria, New South Wales (AU)

( * ) Notice: Subject to any disclaimer, the term of this patent is extended or adjusted under 35 U.S.C. 154(b) by 690 days.

(21) Appl. No.: 12/327,067

(22) Filed: Dec. 3, 2008

(65) Prior Publication Data

US 2009/0173262 A1 Jul. 9, 2009

(30) Foreign Application Priority Data

Jan. 4, 2008 (AU) ..... 2008900045

(51) Int. Cl.
*D05C 15/20* (2006.01)
*D05C 15/04* (2006.01)

(52) U.S. Cl. ..... 112/80.05; 112/80.71

(58) Field of Classification Search .... 112/80.01–80.16, 112/80.54, 80.55–80.73; 700/136–138
See application file for complete search history.

(56) References Cited

U.S. PATENT DOCUMENTS

| | | | | | |
|---|---|---|---|---|---|
| 3,895,355 | A | * | 7/1975 | Shorrock | 700/90 |
| 4,549,496 | A | * | 10/1985 | Kile | 112/80.08 |
| 4,694,761 | A | * | 9/1987 | Golda | 112/80.71 |
| 5,158,027 | A | | 10/1992 | Ingram | |
| 5,165,352 | A | | 11/1992 | Ingram | |
| 5,503,092 | A | * | 4/1996 | Aubourg et al. | 112/80.23 |
| 5,555,826 | A | * | 9/1996 | Satterfield | 112/80.04 |
| 5,979,344 | A | | 11/1999 | Christman, Jr. | |
| 6,293,211 | B1 | * | 9/2001 | Samilo | 112/80.16 |
| 7,218,987 | B2 | * | 5/2007 | Mile et al. | 700/137 |

FOREIGN PATENT DOCUMENTS

| | | |
|---|---|---|
| EP | 1 674 605 | 6/2006 |
| WO | WO 95/14804 | 6/1995 |
| WO | WO 96/25544 | 8/1996 |
| WO | WO 00/68484 | 11/2000 |

OTHER PUBLICATIONS

Search Report, EP08020950, Jun. 2006, Jez et al.

* cited by examiner

*Primary Examiner* — Ismael Izaguirre
(74) *Attorney, Agent, or Firm* — KMF Patent Services, PLLC; Kenneth M. Fagin, Esq.

(57) ABSTRACT

The invention concerns an improved tufting machine which comprises a tufting head translatable within said tufting machine in X- and Y-directions with respect to backing fabric by means of a movement system. The tufting head comprises a tufting mechanism having a cyclic mode of operation, a hollow needle mounted in the tufting mechanism that is moveable relative to a cooperating foot in a reciprocating manner to insert a tuft of yarn into backing fabric in each cycle, a yarn supply mechanism mounted in the tufting mechanism and operable to supply a length of yarn to the hollow needle in each cycle, a yarn cutter mounted in the tufting head that is selectively operable to cut the length of yarn in selected cycles to produce loop or cut pile, and a computer-operated motion control system.

14 Claims, 12 Drawing Sheets

TUFTING MACHINE

CROSS-REFERENCE TO RELATED APPLICATIONS

The present application claims priority from Australian Provisional Patent Application No 2008900045 filed on 4 Jan. 2008, respectively, the contents of which are incorporated herein by reference.

TECHNICAL FIELD

This invention concerns improvements in the production of "hand tufted rugs", carpets and wall hangings by using a "tufting gun". A tufting gun employs a single hollow needle through which yarn is fed by high pressure air or by mechanical means, into a backing material, to form tufts of yarn, which tufts may be cut pile or loop pile. Such "tufting guns", as in this invention, are controlled and guided automatically via a computer controlled tufting machine that uses vector based design definition to tuft a nominated three dimensional design in one or more yarn colours.

BACKGROUND ART

Textured effects in tufted rugs and carpets are created by the use of designs which intermingle cut pile and loop pile effects frequently. It is therefore desirable to be able to automatically and quickly switch between cut and loop pile when producing tufted rugs and carpets.

Also desirable is the ability to be able to tuft different colour areas in the same design. It is for this reason that broadloom type multi-needle tufting machines are undesirable. Broadloom type multi-needle tufting machines typically use a row of several hundred needles to insert row after row of tufts simultaneously into backing fabric which is drawn continuously passed them. These machines are restricted in being able to tuft different colour areas since each needle is threaded with one specific colour for the entire deign and as the machine tufts row by row from bottom to top of the tuft, the tuft locations of each needle always have the same colour.

U.S. Pat. No. 7,218,987 describes a tufting machine which is guided automatically via a computer controlled machine using vector based design definition and which is able to automatically switch between cut pile and loop pile in a given design. The machine is further able to automatically raise the foot and operate the yarn cutter at the ends of a section of loop pile so that it can then traverse to another disconnected section of the design. Such a machine ensures correct registration of adjacent tufts having different coloured threads.

To further stimulate interest and sales, rug designers are looking for new design techniques and methods of tufting rugs. Accordingly it is desirable to produce multi-coloured tufted rugs having variable pile height. To accentuate colour boundaries on cut pile tufted rugs, the edge between bordering colours may be bevelled into a V-shape. This process is performed manually with a hand held carving tool after having completed tufting of the rug. However it is a highly skilled labour intensive process, is prone to errors and is often prohibitively expensive.

It has not been possible using known machinery to tuft different colour areas in a single design with gradual changes in pile height to produce three dimensional sculpting using loop and/or cut pile.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

SUMMARY OF THE INVENTION

The present invention provides a tufting machine comprising:

a tufting head translatable within said tufting machine in X- and Y-directions with respect to backing fabric by means of a movement system, which tufting head comprises:

- a tufting mechanism having a cyclic mode of operation;
- a hollow needle mounted in the tufting mechanism that is moveable relative to a cooperating foot in a reciprocating manner to insert a tuft of yarn into backing fabric in each cycle;
- a yarn supply mechanism mounted in the tufting mechanism that is operable to supply a length of yarn to the hollow needle in each cycle; and
- a yarn cutter mounted in the tufting head that is selectively operable to cut the length of yarn in selected cycles to produce loop or cut pile; and a computer-operated motion control system; adapted to read a machine-readable tufting design pattern comprising a series of vectors and associated control codes and, in response thereto, to generate signals to drive the tufting head (a) to operate the tufting mechanism and reciprocate the needle to insert tufts into backing fabric; (b) to operate the movement system and move the needle across a two-dimensional plane defined by said X- and Y-directions while inserting tufts in accordance with the vectors; (c) to lift and lower the foot in accordance with respective control codes; (d) to selectively operate the yarn cutter in accordance with respective control codes; and (e) to operate the yarn supply mechanism to selectively provide different lengths of yarn in different cycles in accordance with respective control codes, and so to individually vary the pile height of both cut and loop tufts.

Preferably the yarn supply mechanism comprises: a yarn feed motor; a yarn feed roller arranged to be rotatably driven by the yarn feed motor; and a controller to receive signals from the computer-operated motion control system indicative of the length of yarn for a given tuft and in response to determine the speed of revolution of the yarn feed motor.

The yarn feed motor may be in the form of a stepper motor driven in an open loop configuration. The yarn feed motor may be in the form of a servo motor driven in a closed loop configuration.

The yarn supply mechanism may further comprise an idle feed roller arranged adjacent to the yarn feed roller.

The yarn supply mechanism may further comprise a first guide device disposed upstream of the yarn supply mechanism. The first guide device may comprise an eyelet. The yarn supply mechanism may further comprise a second guide device disposed downstream of the yarn supply mechanism. The second guide device may also comprise an eyelet.

The tufting head may further comprise a sensor associated with the yarn supply mechanism to detect an absence of yarn when tufting. The sensor may be any, suitable sensor known by those of skill in the art.

The tufting machine may be operated to produce a three dimensional tufted pattern having both cut and loop pile. It is able to automatically switch between tufting areas of cut pile and areas of loop pile. The machine is also able to automatically raise the foot and operate the yarn cutter at the ends of a section of loop pile, so that it can then traverse to another disconnected section of the design. The foot is generally raised and lowered by moving the entire tufting head relative to the backing fabric.

The tufting head may involve a pneumatic yarn delivery means in which case the yarn is pushed through the hollow needle by compressed air into backing fabric to form tufts of yarn. Alternatively the tufting head may be entirely mechanical, utilizing a forked blade within the needle to push the yarn into the backing fabric.

The yarn cutter may be arranged in a variety of different ways in order to achieve selective operation. In general the yarn cutter moves through its own cutting cycle as the tufting mechanism moves through a tufting cycle. In one arrangement the cutter may be selectively rendered operable by being engaged to move through its cutting cycle, or be disengaged and stationary during selected tufting cycles. In an alternative the cutter may be allowed to cycle in every tufting cycle, but be moved between a cutting position where the yarn is cut each cycle, and another position in which the yarn is not cut.

A blade in the yarn cutter may be employed to perform the cutting operation. The blade may be arranged to move during the cutting cycle in a linear fashion back and forth across the axis of the tufting needle. Alternatively, the blade may be moved in a rotary fashion about the tufting needle axis.

The control system is able to read tufting design patterns, comprising a series of vectors and associated control codes, in which a large number of parameters may be used to vary different aspects of tufting. For example: Stitch Length; Pile Height; Pile Heights; Cut Pile; J-Tuft, Loop Pile; Raise Foot or Tufting Head; Lower Foot or Tufting Head; Cut Yarn; Enable Yarn Cutter; Disable Yarn Cutter; Change Colour.

The tufting needle may be mounted in the tufting mechanism in a manner that allows it to be rotated freely in either direction about its axis. The foot and needle may comprise inter-engaging formations so that the needle may be driven in rotation by the foot. The foot may be driven in rotation by any suitable mechanism.

It is an advantage of at least one embodiment of the invention that the pile height is able to be automatically changed on a vector by vector basis (or if the vectors are sufficient small, on a tuft by tuft basis). The effect of this is that loop pile areas can be a different pile height than cut pile areas, and a design may have multiple different pile heights of loop pile in different parts of the design.

A further advantage of at least one embodiment of the invention that three dimensional tufted rugs are able to be produced having sculptured shapes in different yarn colours using variable pile heights in loop or cut pile.

A still further advantage of at least one embodiment of the invention is the ability to automatically tuft simulated carving by varying the pile heights of several rows of tufts parallel and adjacent to colour area boundaries to form a bevelled edge.

BRIEF DESCRIPTION OF THE DRAWINGS

An example of the invention will now be described with reference the accompanying drawings, in which:

FIGS. 4 to 7 each include a scratch section showing the relationship between the needle and blade of the yarn cutter.

BEST MODES OF THE INVENTION

Figure 1:
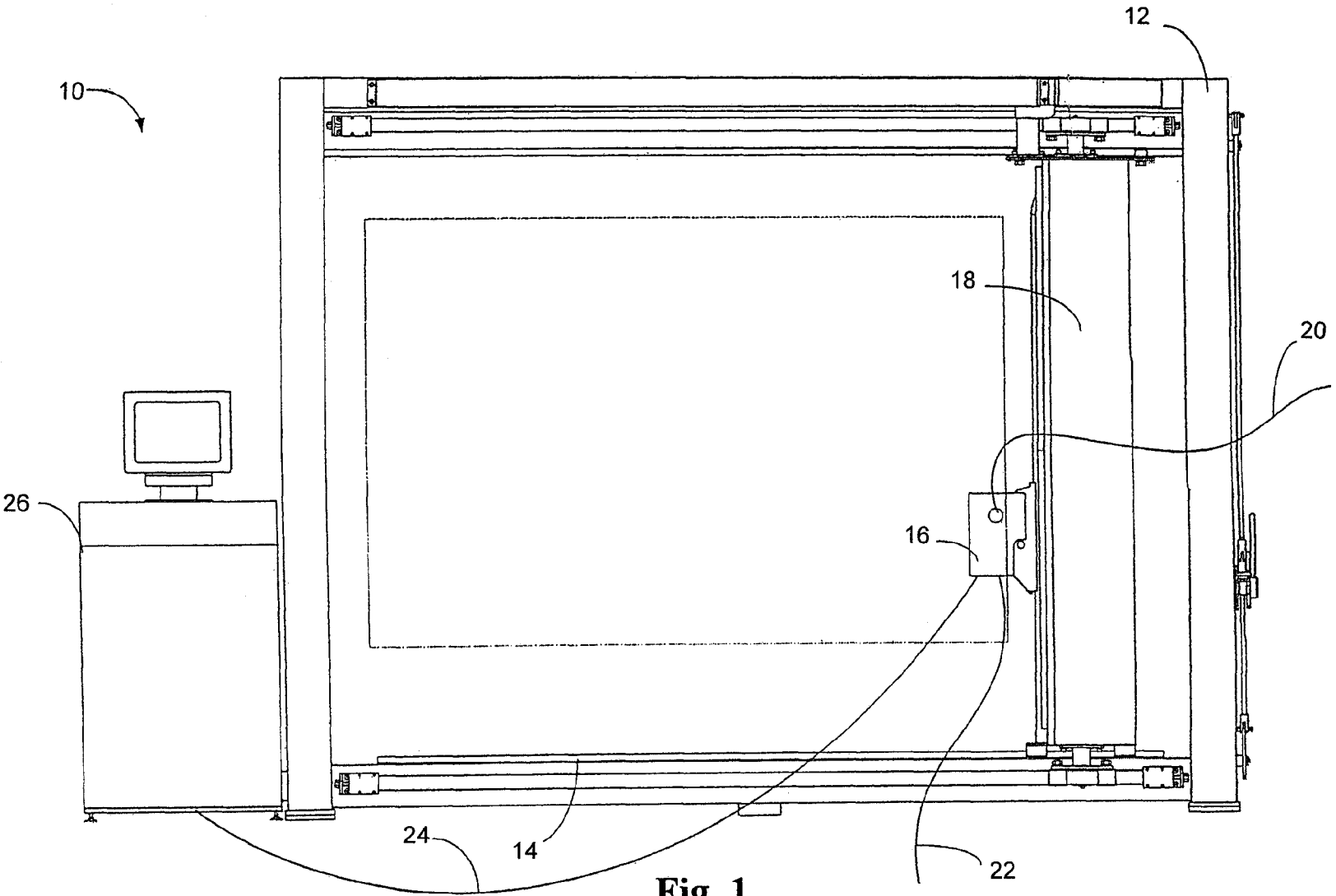
FIG. 1 is a pictorial diagram of an improved tufting machine.

Referring first to FIG. 1 tufting machine 10 comprises a stand 12 onto which a stretch frame 14 can be mounted. In use, backing fabric is mounted on stretch frame 14. A tufting head 16 is also mounted on the stand in a movement system 18 that is able to translate in X- and Y-directions over the backing fabric. Yarn 20 is provided to the tufting head 16, as well as compressed air 22, electrical power and control signals 24. The control signals 24 are supplied from a computer-operated motion control system 26 which is operable under the control of a machine readable tufting design pattern comprising a series of vectors and associated control codes.

Figure 2:
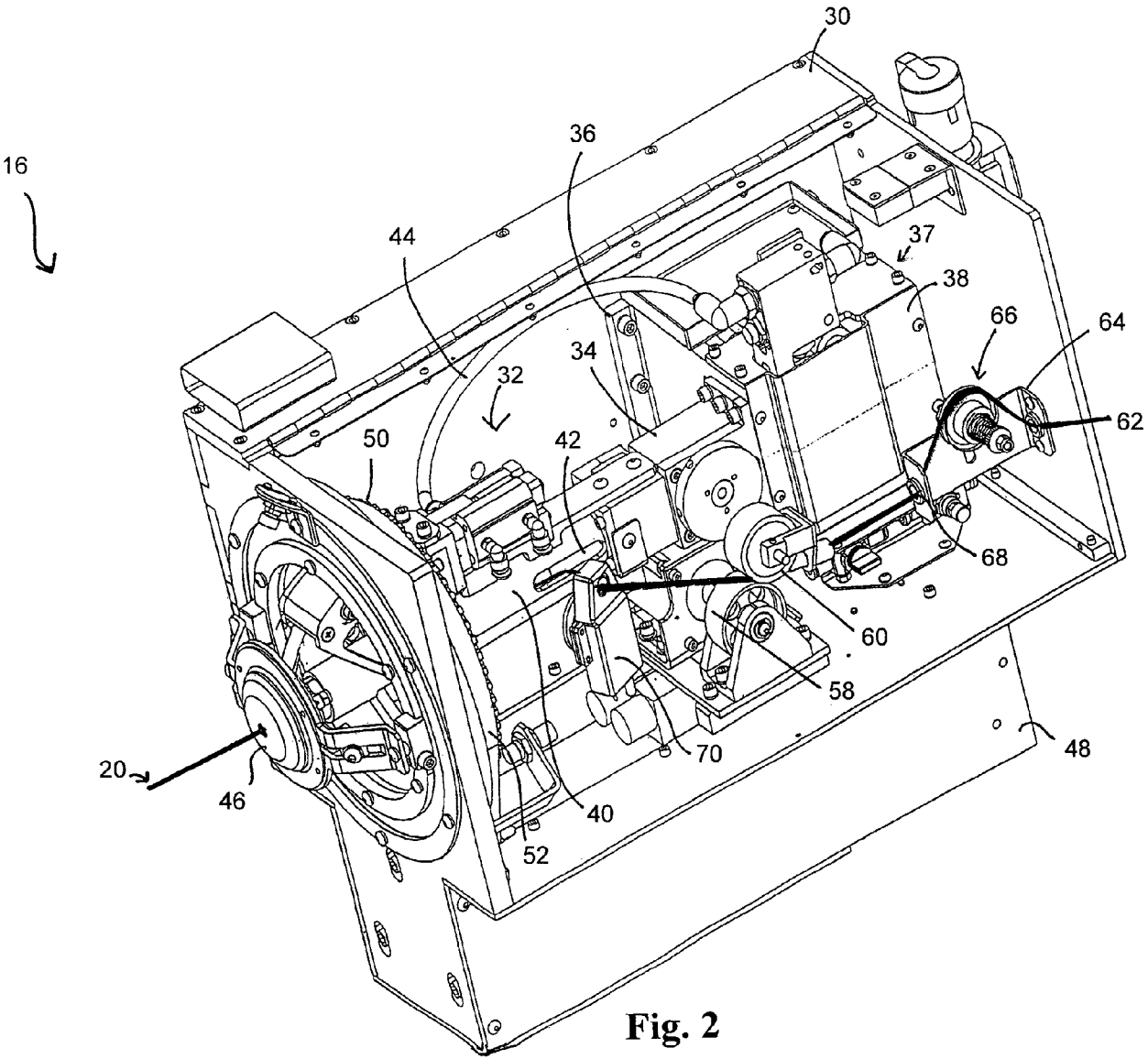
FIG. 2 is a pictorial diagram of a tufting head from the front and left side.

Referring to FIG. 2 the tufting head 16 comprises a frame 30 in which is mounted a tufting mechanism, indicated generally at 32. The tufting mechanism 32 has a gearbox 34 that is mounted to a motor mounting bracket 36 which holds an electric drive motor 37 in the frame 30. A tufting head barrel 40 extends forwardly from gearbox 34.

Within barrel 40 is a reciprocating inner barrel (not shown) through which yarn 20 is supplied via slot 42 in the barrel to a hollow needle (not shown). Compressed air is fed to the yarn tube via pipe 44 to drive the yarn down through the inner barrel to the needle at the correct point in the reciprocating motion, when the needle has pierced the backing fabric. In use electric drive motor 37 behind cover 38 provides drive to gearbox 34 via a timing belt and sprocket for rotary motion of an eccentric and crank (not shown). The crank engages the inner barrel via a slot (not shown) to reciprocate the needle up and down through foot 46. A second electric motor (not shown) behind cover 48 drives a wheel 50 via a belt 52 to rotate the foot 46 and the needle.

Figure 3:
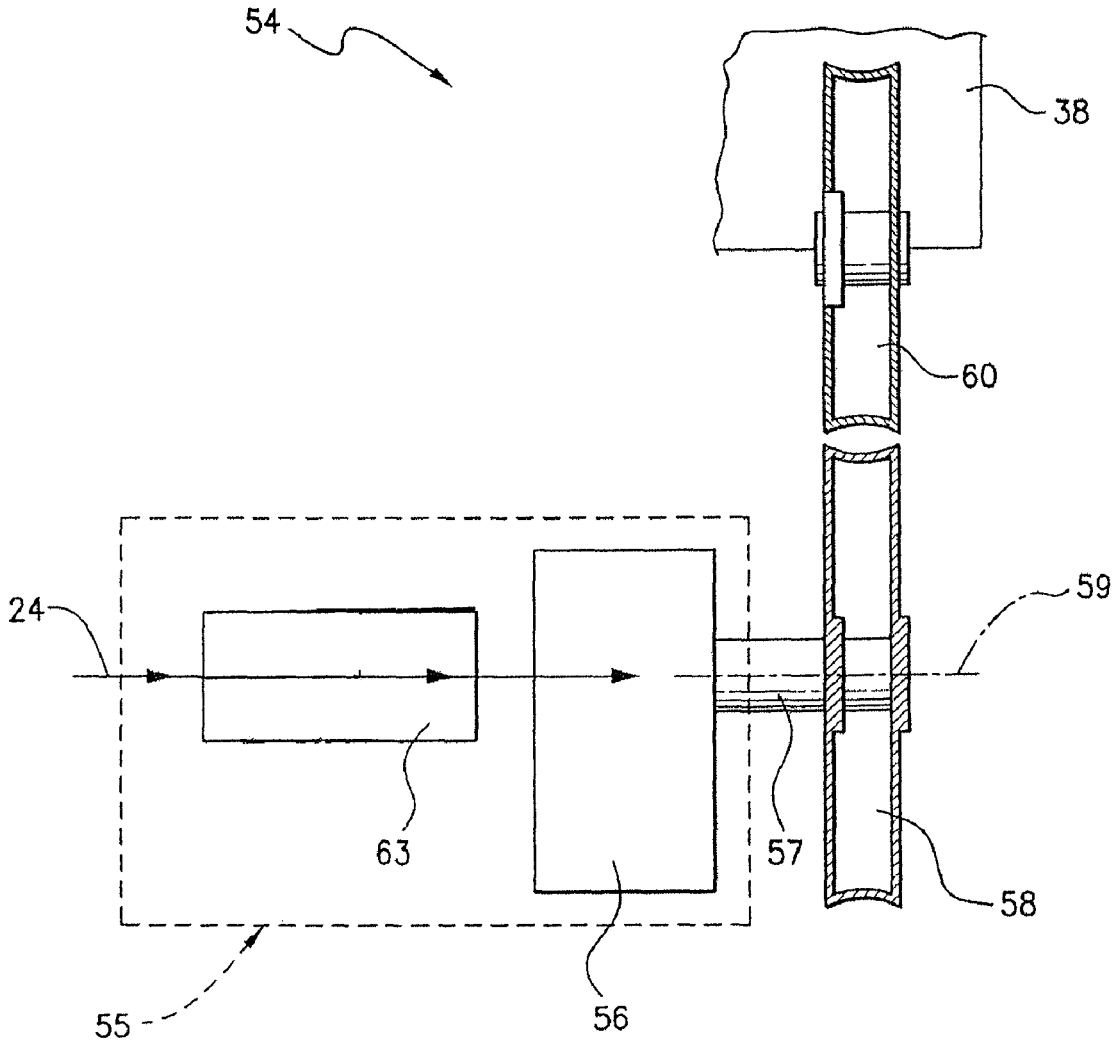
FIG. 3 is a pictorial diagram of a variable yarn supply mechanism illustrated in FIG. 2.

A yarn supply mechanism 54 is shown in isolation in FIG. 3. The yarn supply mechanism 54 includes a stepper motor system 55 and a yarn feed roller 58 rotatably supported by shaft 57 about pivot axis 59. The stepper motor system 55 includes a power amplifier 63 and a yarn feed motor in the form of a stepper motor 56. The yarn feed roller 58 is secured to a drive shaft 57 of the stepper motor 56. An idle feed roller 60 is arranged relative to the yarn feed roller 58 and is mounted to cover 38. Yarn feed roller 58 pinches the yarn to feed the yarn when the yarn feed motor 56 is turning, and to prevent the yarn from being dragged into the backing material by the needle when the yarn feed motor 56 is not turning.

The stepper motor system 55 operates under control of control signals 24 supplied from the computer control system (FIG. 1) and automatically controls, sets, and varies the amount of yard feed per tuft, and hence the pile height of each tuft in a tufted rug by controlling the extent of rotation of the yarn feed roller 58 in a given cycle. The yarn is driven by the yarn feed roller 58 for as long as is necessary to generate the required pile height.

When the control system 26, on reading the machine-readable tufting design pattern, registers a change in pile height, the computer control system sends a signal 24 to the controller 61 indicative of the nominated yard feed length for a given tuft. The controller 61 calculates the number of revolutions or fraction of a revolution of the yarn feed roller 58 required to produce the nominated yarn feed length and generates an appropriate signal for the amplifier 63 which in turn converts the signal into the power necessary to energise the yarn feed motor's windings. For instance, if the stepper motor 56 is driven at 400 steps per revolution, then the increments in the rotational position which are required per stitch is equal to the number of revolutions (or fraction of a revolution) of the yarn feed roller 58 multiplied by 400. In continuous operation the electric drive motor 37 is driven at a nominated speed in tufts per minute (RPM) of the tufting mechanism 32. The yarn feed motor 56 then operates at a speed proportional to the electric drive motor 37 to feed the nominated amount of yarn for each revolution of the electric drive motor 37. In effect, it is the positioning axes (X, Y and Yarn Feed) of the stepper motor 56 which are interpolated and driven at a speed proportional to the electric drive motor 37 such that the RPM of the stepper motor 56 which results is determined by the number of tufts per minute multiplied by the fraction of a revolution per tuft required for the nominated amount of yarn feed per stitch.

Referring back to FIG. 2, yarn, from the yarn supply (not shown) is fed through a first aperture 62 on a support yarn plate 64 and then through a yarn tension disc assembly 66. The yarn tension disc assembly 66 comprises a pair of co-operating discs mounted face to face between which the yarn runs. The yarn is then fed through a second aperture 68 on the support yarn plate 64. The yarn then passes between the idle feed roller 60 and the yarn feed roller 58 before passing through an aperture in a yarn sensor 70 and fed into slot 42. The yarn sensor 70 detects the presence or absence of yarn when tufting. If no yarn is detected a signal is sent to the computer control system (FIG. 1) which then stops the machine tufting. To effect the passage of yarn, yarn feed roller 58 has a knurled surface for the purpose of increasing friction with the yarn. In contrast, idle feed roller 60 is manufactured from a rubber, the surface of which is smooth.

Referring now to FIGS. 4 to 7, a yarn tube 80, which is within the reciprocating inner barrel 106, and hollow needle 82 are now visible, as is a needle bearing 83 and needle holder 85. A yarn cutter, indicated generally at 84, is mounted in the mechanism to cut the yarn in selected cycles to produce loop or cut pile. The yarn cutter comprises an elongated blade 90 mounted in a blade holder 92 so that it extends parallel to the axis 100 of needle 82. An arm 94 is pivoted from the inner barrel 106 at 96 and has rollers (not shown) through which the blade 90 is passed to curve it so that the cutting tip 98 is advanced toward the yarn tube 80 and needle axis 100.

Figure 4:
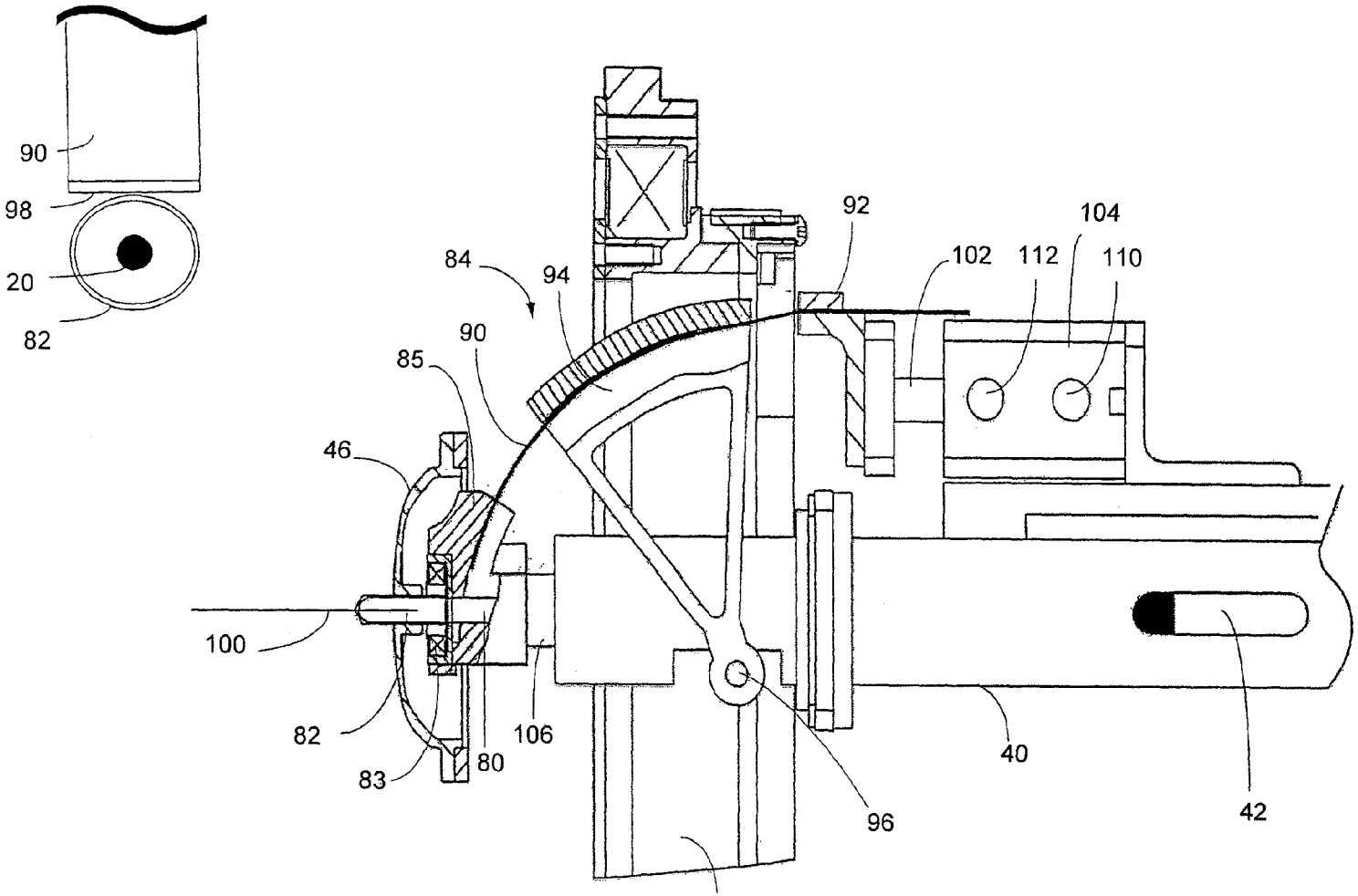
FIG. 4 is a sectional view of part of a tufting head from the side in a first configuration where the yarn cutter is engaged but the blade is not in the cutting position.

Blade holder 92 is mounted on the end of a piston 102 extending from a pneumatic cylinder 104. In FIG. 4 piston 102 is extended and the yarn cutter 84 is engaged. Also in FIG. 4 it can be seen that the needle 82 is advanced through foot 46 to deliver yarn into the backing fabric. The advance of the needle can be seen by the extension of inner barrel 106 from barrel 40, and also by the end of inner barrel 106 visible at slot 42. The yarn 20 is fed into inner barrel 106 at its end which is accessible by slot 42.

Figure 5:
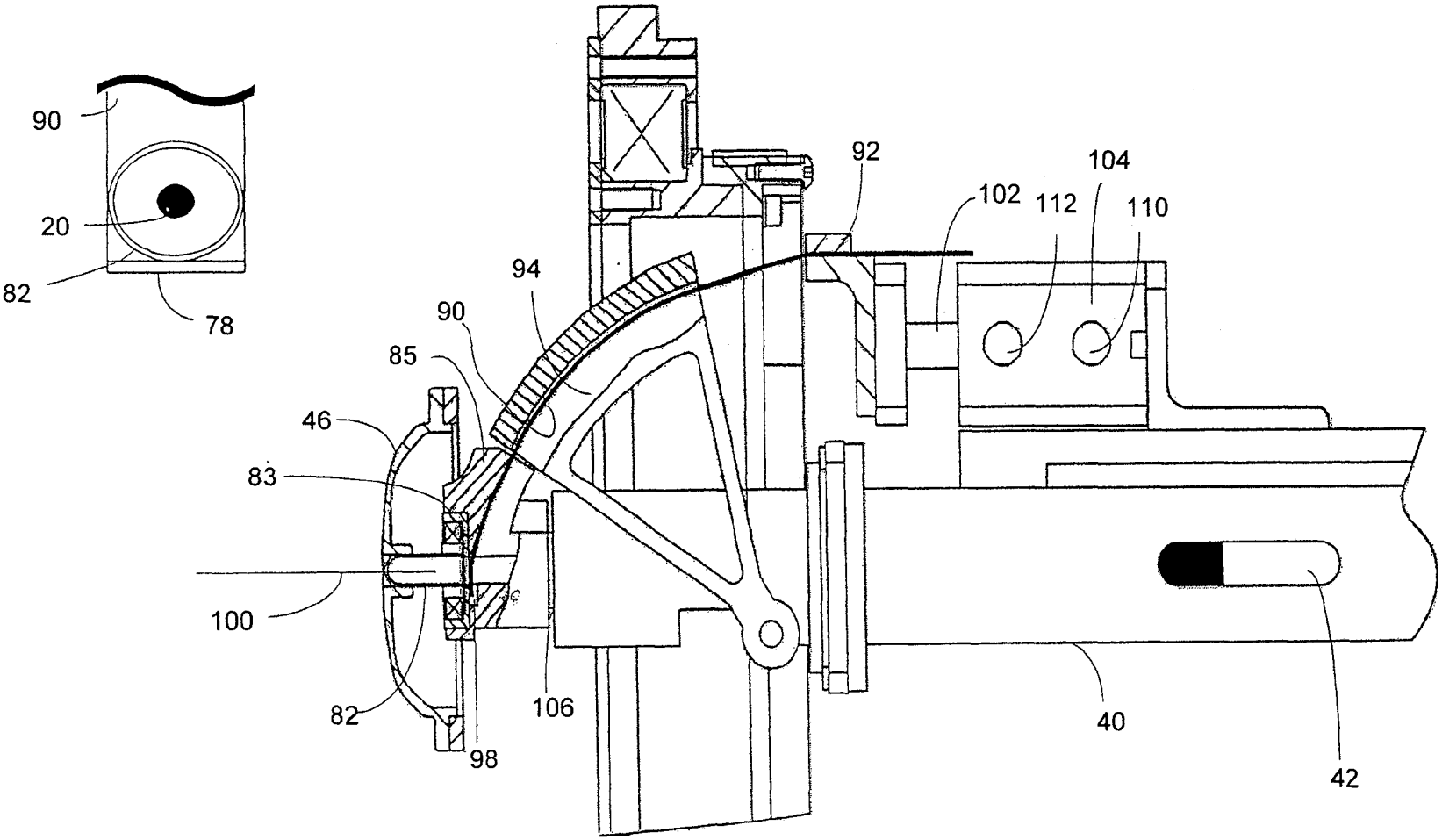
FIG. 5 is a sectional view of part of a tufting head from the side in a first configuration where the yarn cutter is engaged and the blade is in the cutting position.

In FIG. 5 piston 102 remains extended and the yarn cutter 84 is still engaged. However, needle 82 has been withdrawn from foot 46 and inner barrel 106 is seen to be withdrawn into barrel 40; as can also be seen in slot 42. As a result of the movement of the needle the tip 98 of blade 90 is advanced across the back of the needle holder 85 past axis 100 and therefore cuts the yarn 20. Since during each tufting cycle the inner barrel 106 which supports the needle holder 85 and the needle 82 is reciprocated inside the stationary outer support barrel 40, the blade 90 will cut the yarn 20 in each tufting cycle. As a result the machine will produce cut pile.

Figure 6:
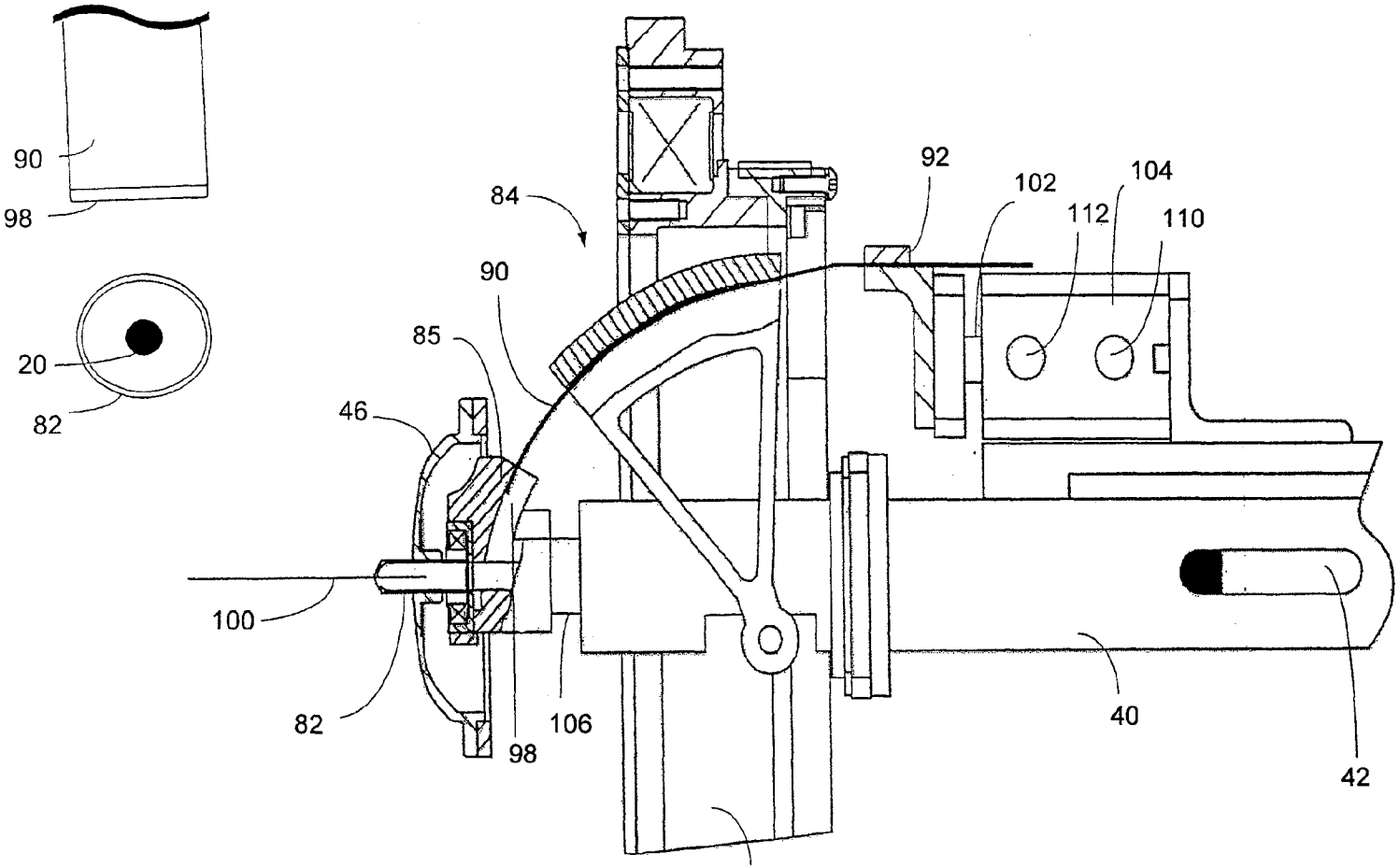
FIG. 6 is a sectional view of part of a tufting head from the side in a second configuration where the yarn cutter is disengaged and the blade is not in a cutting position.

In FIG. 6 it can be seen that the needle 82 is advanced through foot 46 to deliver yarn into the backing fabric. The advance of the needle can again be seen by the extension of inner barrel 106 from barrel 40, and also at slot 42. In this case piston 102 is retracted into cylinder 104 and the yarn cutter 84 is disengaged. As a result the tip 98 of blade 90 is withdrawn far from needle 82.

Figure 7:
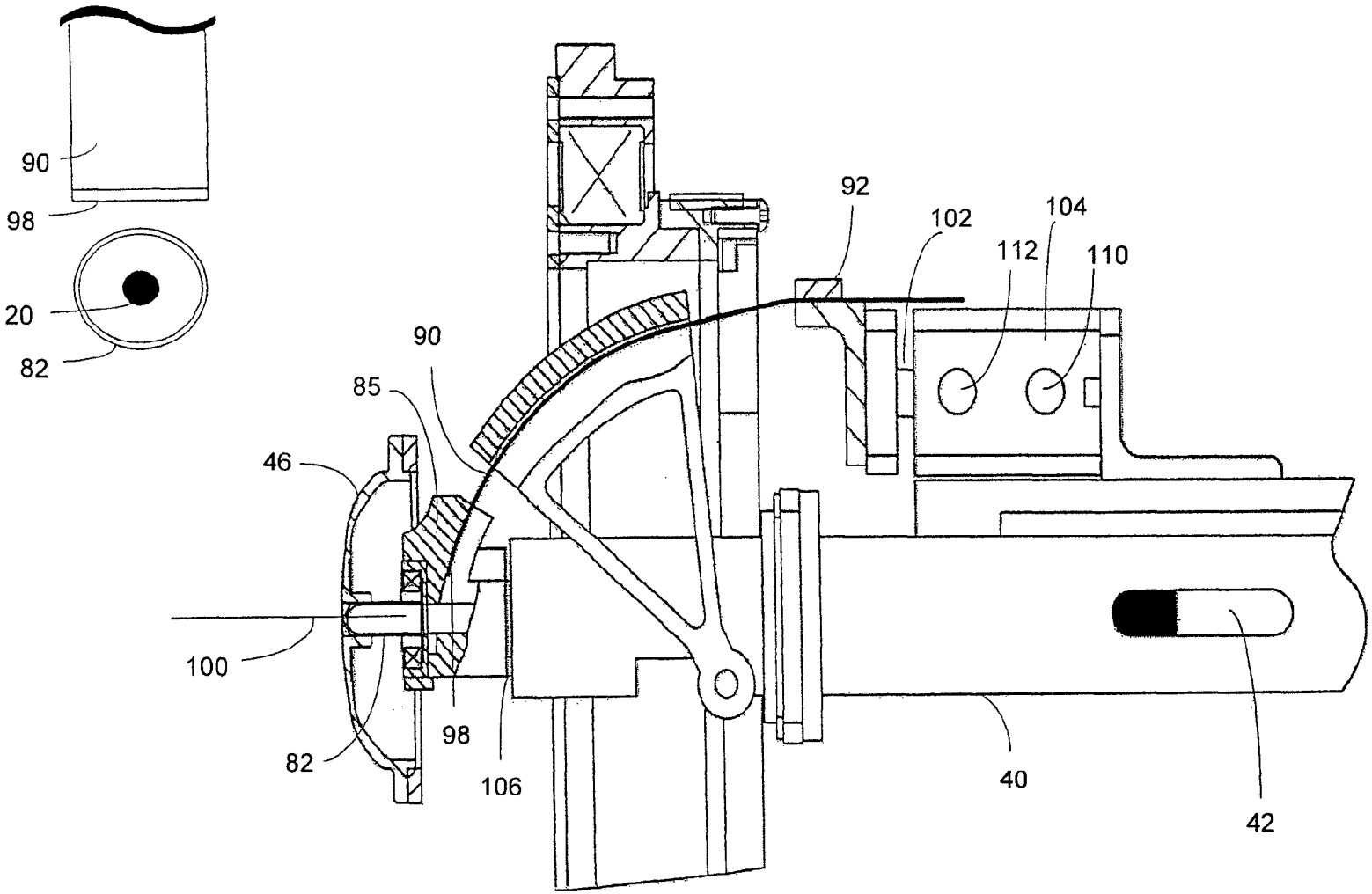
FIG. 7 is a sectional view of part of a tufting head from the side in the second configuration where the yarn cutter is disengaged and the blade is not in a cutting position.

In FIG. 7 piston 102 remains withdrawn and the yarn cutter 84 is still disengaged. However, needle 82 has been withdrawn from foot 46 and inner barrel 106 is seen to be withdrawn into barrel 40; see also slot 42. As a result of the movement of the needle the tip 98 of blade 90 is advanced towards the needle mount 85 but does not pass behind needle 82 and therefore does not cut the yarn. As a result the machine will produce loop pile.

By selectively operating cylinder 104 and piston 102 the tufting head is selectively and automatically switched between producing cut and loop pile. Cylinder is operated by compressed air supplied through two air inlet ports 110 and 112 via pneumatic hoses which drive it positively to extend and retract piston 102.

The tufting machine is operated by a computer operated control system having a number of degrees of freedom. The control system is operable under the control of a machine readable tufting design pattern. The tufting design pattern for a tufted rug is prepared by a designer using a software system to create the design and designate what pile heights, pile types, and yarn colours are wanted in what parts of the design. The values of yarn feed for each tuft required to achieve the desired pile heights are calculated and stored in a design file associated with the tufting design pattern. The structure of the design pattern produced by the software system is essentially a series of vectors with associated control codes which are also stored in the design file. The vector end points define the path along which to tuft, and the control codes contain parameters to define the tufting that should be done. The determination of vector end points is described in U.S. Pat. No. 5,503,092, the contents of which are incorporated herein.

Figure 8A:
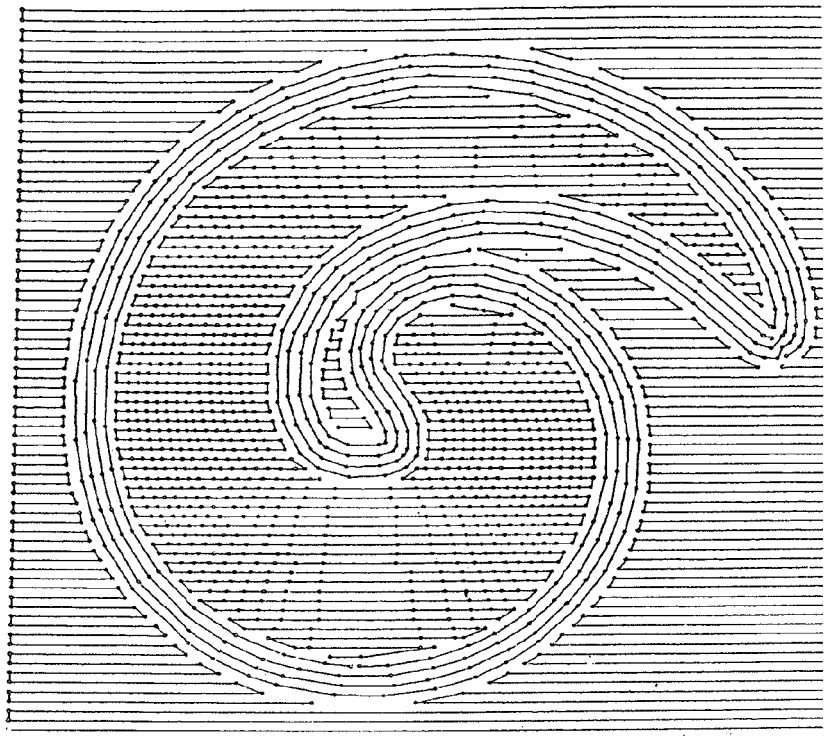
FIG. 8A is a pictorial diagram of a tufting design pattern illustrating the vector points calculated at the transition points.
Figure 8C:
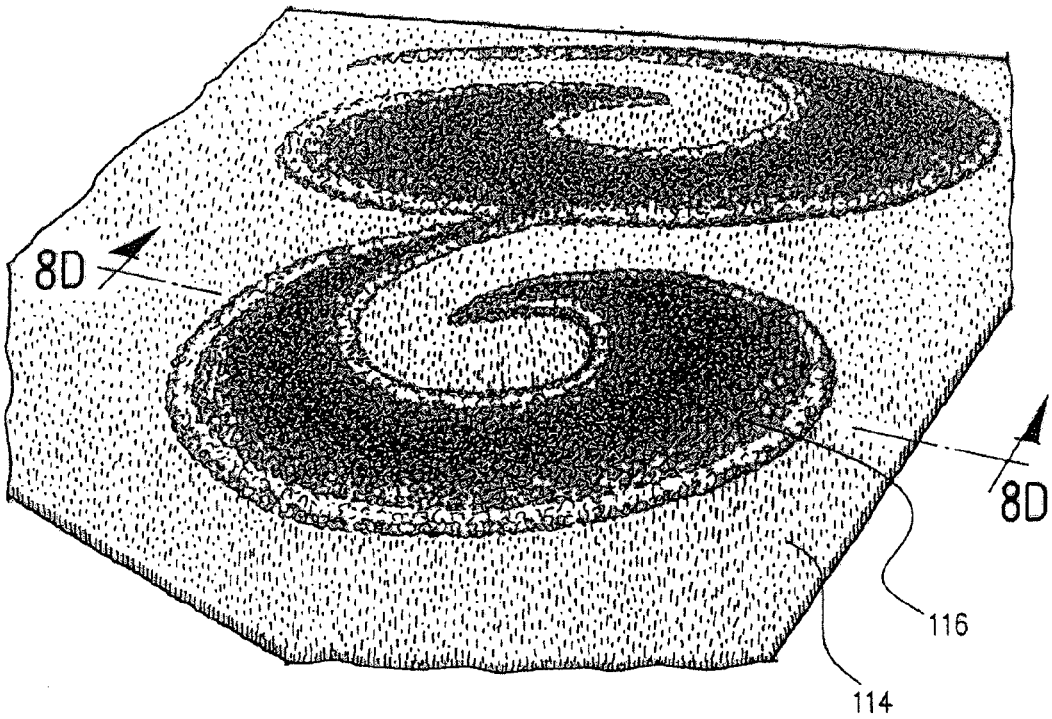
FIG. 8C is a perspective illustration of a three dimensional tufted rug, a portion of which incorporates the tufting design pattern illustrated in FIGS. 8A and 8B, with FIG. 8D being a section view taken along the cutting line 8D-8D as shown in FIG. 8C.
Figure 8B:
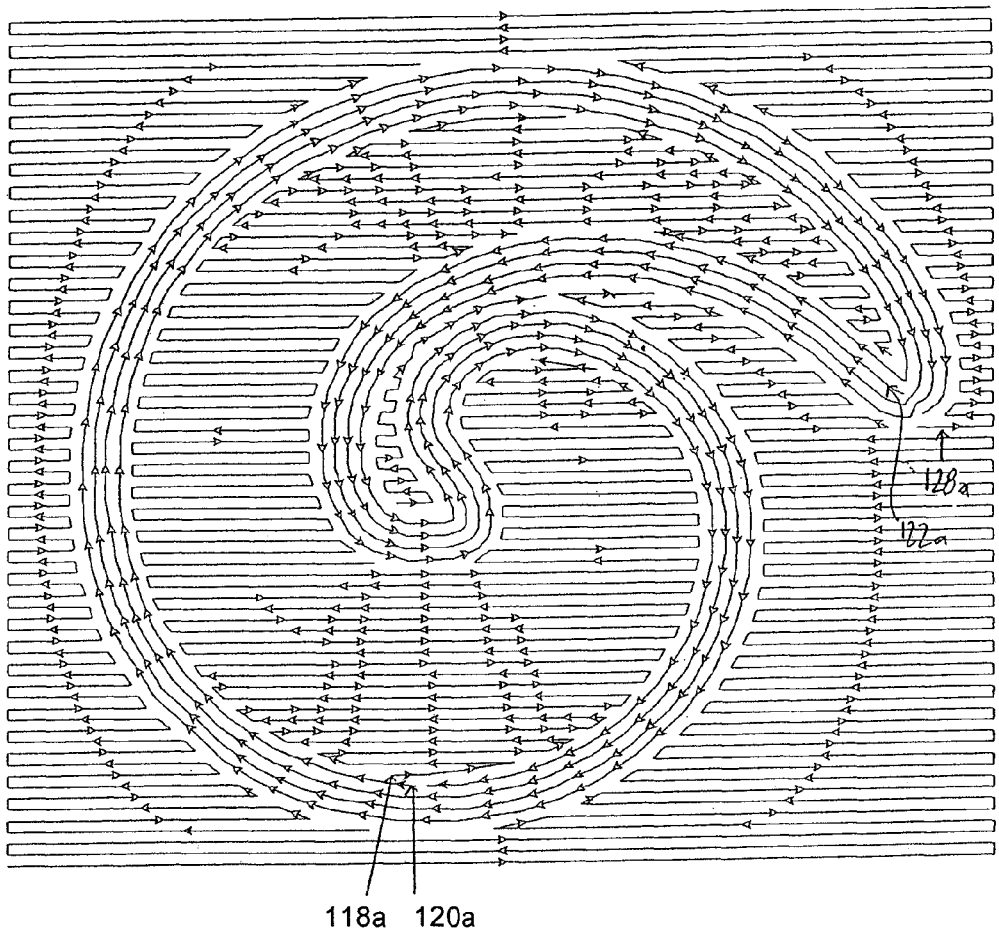
FIG. 8B is a pictorial diagram illustrating the sequence of tufting the design pattern.
Figure 8D:
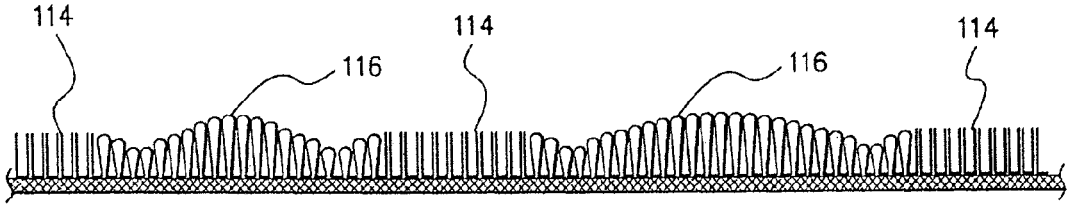

The computer operated control system of the tufting machine reads the instructions in the design file and controls the variable yarn supply mechanism in conjunction with the other machine functions to tuft a rug according to the tufting design pattern. FIGS. 8A and 8B illustrate a tufted design pattern which is used to produce a portion of the tufted rug shown in FIG. 8C. In FIG. 8C the background border 114 surrounding the three dimensional patterned area 116 is cut pile and of a first colour whilst the three dimensional patterned area 116 is loop pile and of a second colour. The pile heights of several rows of tufts parallel and adjacent to colour area boundaries are varied to form a bevelled edge.

Figure 9A:
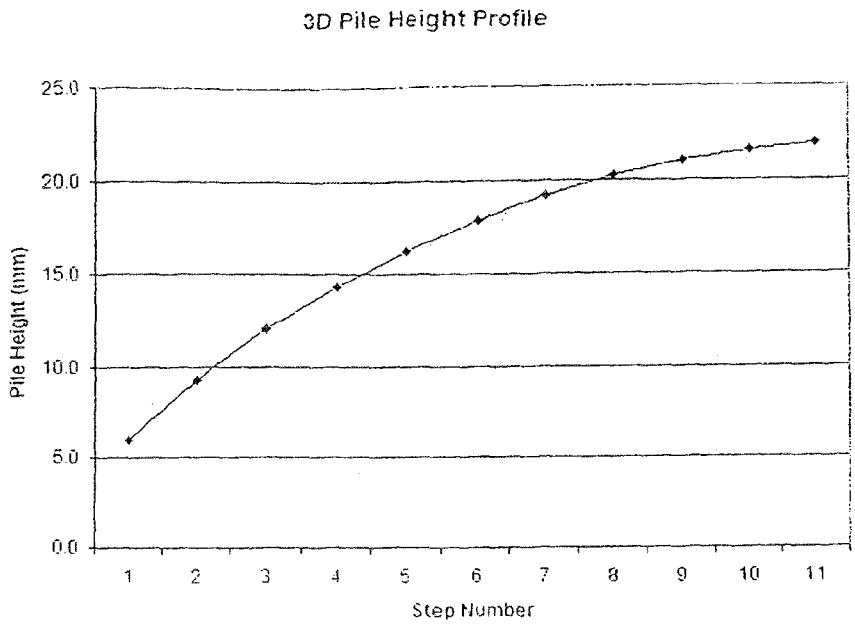
FIGS. 9A and 9B illustrate graphs showing the 3D pile height profiles for two different profiles.

With regard to formulating the control codes, the designer initially decides the 3D profile of pile heights wanted. By specifying a first pile height at the start of a vector, and a second pile height for the last stitch in the vector and the number of steps, the controller calculates the value of the intermediate pile heights for each step to get the desired shaped profile in cross section. When the vector length is equal to the stitch length then the result is a single stitch per vector. The following table exemplifies the profile determination for a circular profile which is illustrated in FIG. 9A.

| # Steps | First Pile Height (mm) | Last Pile Height (mm) | Profile | % curve |
|---|---|---|---|---|
| 11 | 6.0 | 21.9 | Circular | 75% |
| 1 | 9.3 | | | |
| 2 | 12.1 | | | |
| 3 | 14.4 | | | |
| 4 | 16.3 | | | |
| 5 | 17.9 | | | |
| 6 | 19.2 | | | |
| 7 | 20.2 | | | |
| 8 | 21.0 | | | |
| 9 | 21.6 | | | |
| 10 | 21.9 | | | |

Figure 9B:
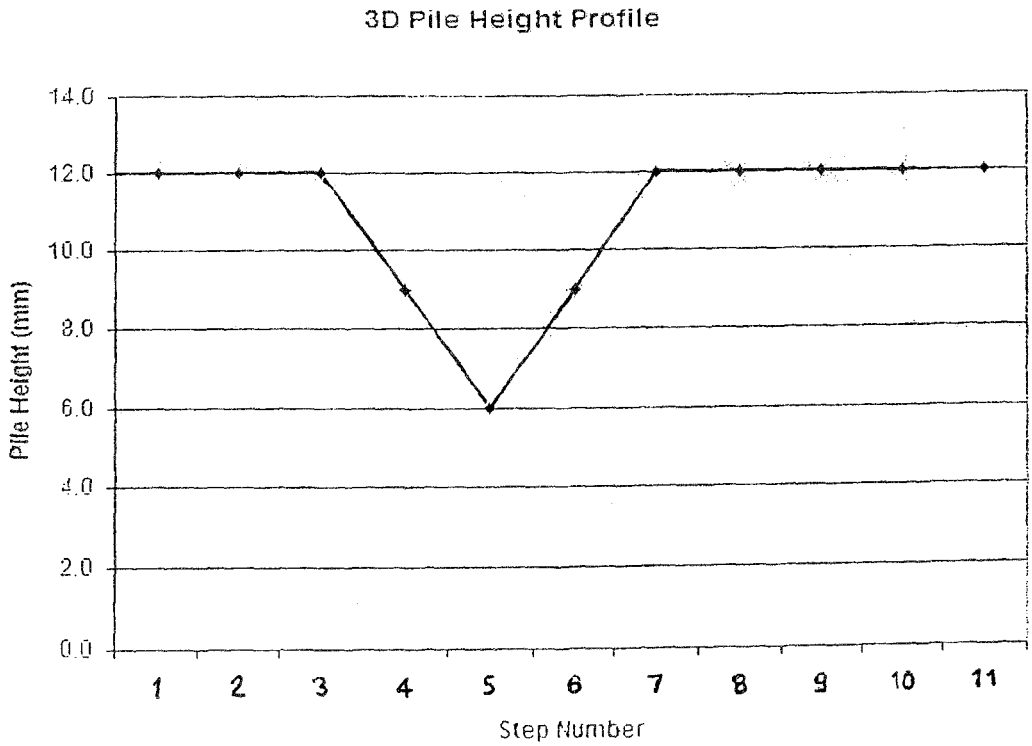

It is understood that alternate profiles such as linear, parabolic and notched (as shown in FIG. 9B) may be utilised.

The tufting design pattern is then prepared, whereby in this example, different bitmap colours are used to represent different pile heights.

Figure 10:
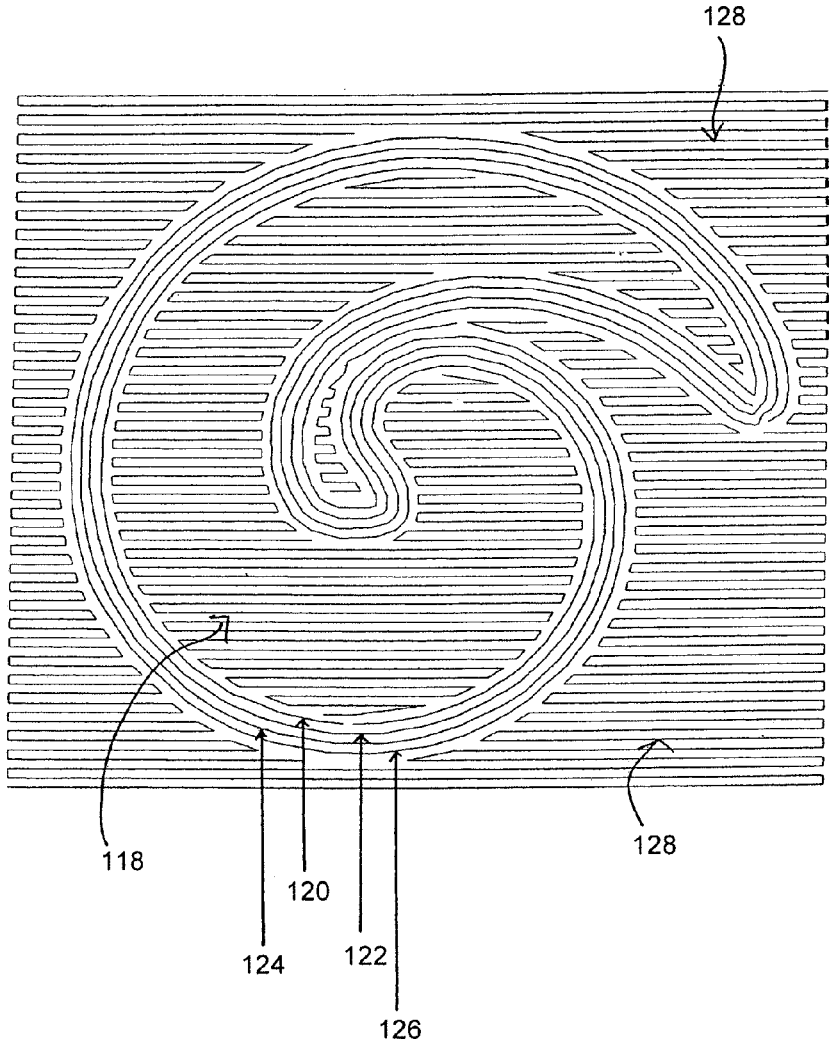
FIG. 10 is an illustration of a vector diagram of a portion of the tufting design pattern illustrated in FIG. 8A.

FIG. 10 illustrates a vector diagram of a portion of the pattern in which colour index (1) representative of a pile height of 21.9 mm is designated 118, colour index (11) representative of a pile height of 6.0 mm is designated 120, colour index (12) representative of a pile height of 6.0 mm is designated 122, colour index (13) representative of a pile height of 9.3 mm is designated 124, colour index (14) representative of a pile height of 12.1 mm is designated 126 and colour index (15) representative of a pile height of 14.0 mm is designated 128. For simplicity not all colours, and therefore pile heights, are shown.

The designer then defines the pile specifications, calculates the yarn feed length per tuft together with the meters of yarn required per $m^2$ (dependent on the number of tufts per $m^2$).

The following table exemplifies a determination of the pile specification values together with the yarn feed length per tuft for a tufted loop rug.

Pile Specification values:

| ID | Pile Spec Name | Type | Row Space (mm) | Stitch Length (mm) (SL) | Finished Pile Height (mm) A | Finished Pile Height (mm) B | Shear (mm) A | Shear (mm) B | Thickness (mm) (TH) | Yarn Feed/ (mm) Tuft |
|---|---|---|---|---|---|---|---|---|---|---|
| PS1 | Loop 6.0 mm | Loop | 5 | 4 | 6 | 6 | 0 | 0 | 2 | 18 |
| PS2 | Loop 9.3 mm | Loop | 5 | 4 | 9.3 | 9.3 | 0 | 0 | 2 | 24.6 |
| PS3 | Loop 12.1 mm | Loop | 5 | 4 | 12.1 | 12.1 | 0 | 0 | 2 | 30.2 |
| PS4 | Loop 14.4 mm | Loop | 5 | 4 | 14.4 | 14.4 | 0 | 0 | 2 | 34.8 |
| PS5 | Loop 16.3 mm | Loop | 5 | 4 | 16.3 | 16.3 | 0 | 0 | 2 | 38.6 |
| PS6 | Loop 17.9 mm | Loop | 5 | 4 | 17.9 | 17.9 | 0 | 0 | 2 | 41.8 |
| PS7 | Loop 19.2 mm | Loop | 5 | 4 | 19.2 | 19.2 | 0 | 0 | 2 | 44.4 |
| PS8 | Loop 20.2 mm | Loop | 5 | 4 | 20.2 | 20.2 | 0 | 0 | 2 | 46.4 |
| PS9 | Loop 21.0 mm | Loop | 5 | 4 | 21.0 | 21.0 | 0 | 0 | 2 | 48.0 |
| PS10 | Loop 21.6 mm | Loop | 5 | 4 | 21.6 | 21.6 | 0 | 0 | 2 | 49.2 |
| PS11 | Loop 21.9 mm | Loop | 5 | 4 | 21.9 | 21.9 | 0 | 0 | 2 | 49.8 |

Figure 11A:
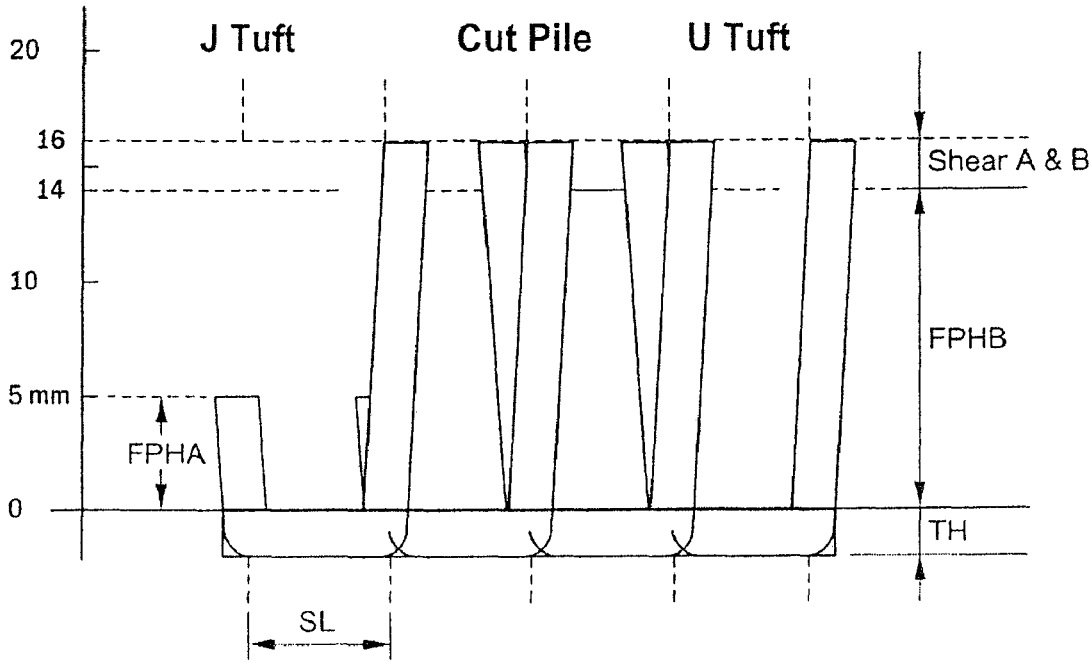
FIG. 11*a* is a pictorial diagram illustrating the determination of the yarn length per tuft for Cut Pile.
Figure 11B:
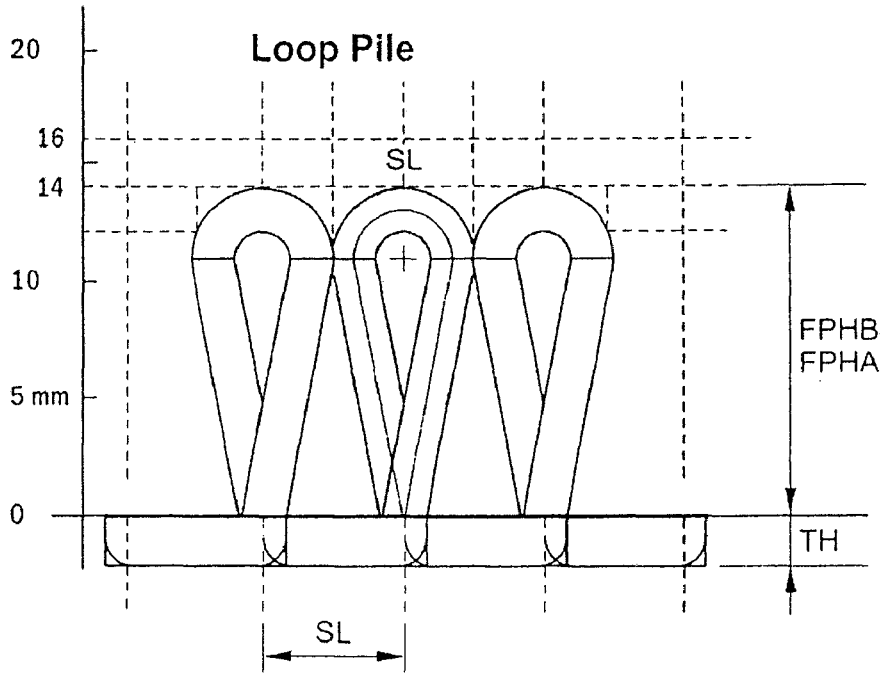
FIG. 11*b* is a pictorial diagram illustrating the determination of the yarn length per tuft for Loop Pile.

FIGS. 11*a* and 11*b* illustrate the determination of the yarn feed, or yarn length, per tuft. For Cut Pile, when Pile Height A equals Pile Height B, (or if Pile Height B is undefined) then "U" shaped cut piles are designated, of equal height, as is shown in the table above. When Pile Height A is different that Pile Height B, then "J" shaped cut piles are designated, where A specifies the first part and B the second part.

For Cut Pile: yarn feed per tuft=SL+TH+FPHA+FPHB+Shear A+Shear B;

For Loop Pile: yarn feed per tuft=SL+TH+FPHA+FPHB; where SL=stitch length, TH=thickness, FPHA=finished pile height of A, FPHB=finished pile height of B.

In the illustrated example, SL=6 mm, TH=2 mm, FPHA=5 mm, FPHB=14 mm, Shear A=Shear B=2 mm.

The designer assigns the yarn specifications and the pile specifications to design colours. The number of yarn specifications is determined according to the number of colours in the design. In this example the design is made up of two colours so two yarn specifications are defined and associated against the pre-specified pile specifications.

Yarn Specifications

| Colour Index | Yarn ID | Pile ID | Pile Spec Name |
|---|---|---|---|
| 1 | YS 1 | PS 11 | Loop 21.9 mm |
| 2 | YS 1 | PS 10 | Loop 21.6 mm |
| 3 | YS 1 | PS 9 | Loop 21.0 mm |
| 4 | YS 1 | PS 8 | Loop 20.2 mm |
| 5 | YS 1 | PS 7 | Loop 19.2 mm |
| 6 | YS 1 | PS 6 | Loop 17.9 mm |
| 7 | YS 1 | PS 5 | Loop 16.3 mm |
| 8 | YS 1 | PS 4 | Loop 14.4 mm |
| 9 | YS 1 | PS 3 | Loop 12.1 mm |
| 10 | YS 1 | PS 2 | Loop 9.3 mm |
| 11 | YS 1 | PS 1 | Loop 6.0 mm |
| 12 | YS 2 | PS 12 | Loop 6.0 mm |
| 13 | YS 2 | PS 13 | Loop 9.3 mm |
| 14 | YS 2 | PS 14 | Loop 12.1 mm |
| 15 | YS 2 | PS 15 | Cut 14.0 mm |

| Yarn ID | Yarn Colour Name | Yarn Type |
|---|---|---|
| YS1 | Scarlet | Wool |
| YS2 | Cobalt Blue | Wool |

The designer, using the software, then calculates vectors to define the shapes and pile specifications. The designer begins by defining vector points as is illustrated in FIG. 8A. Everywhere that a vector crosses a colour area with a different pile specification, a vector point is added with the relevant pile specification number (not shown) at that point.

With reference to FIG. 8B and FIG. 10 the curl shape (designated generally in FIG. 10 by the area 118 and bordered by the tufted outline 120) is tufted with a single outline of tufting around the outside in the lowest pile height 120, beginning at point 120*a* (see FIG. 8B) using a scarlet wool. The inside of the curl, region 118 (FIG. 10), is then filled (still using the scarlet wool) with horizontal fill vectors beginning at point 118*a*. The background (designated in FIG. 10 by the tuft outlines 122, 124 and 126 and the area 128 bordered by tuft outline 126) is tufted with three outlines around the outside of the curl 122, 124 and 126, starting at 122*a*, with respective outlines at a different pile height, and then the area 128 is filled at a constant pile height with horizontal fill starting at 128*a*. For the background a cobalt blue wool is used. It is understood that the fill does not have to be horizontal, it can be at any desired angle. Alternatively shapes may be filled with spiral fill paths. In such an embodiment tufting occurs along constant pile height contours and pile heights need only be changed once per contour instead of one per vector.

Whilst the above example has been described whereby it is only the pile height of the Loop Pile which is being varied, it should be appreciated that it is also possible to vary the pile height of Cut Pile using this same method whilst keeping the Loop Pile of a constant pile height, and further possible to vary the pile height of both Cut Pile and Loop Pile. When employing the invention in an embodiment whereby at least portions of a pattern having Cut Pile are to be of varying pile height it needs to be appreciated that only a first leg of the cut pile specifies the variation in height. That is, the second leg of the cut pile tuft stays a constant pile height as it is dictated by the mechanical length of the needle, whilst the length of the first leg of the cut pile is dictated by how much yarn has been fed by the yarn supply mechanism. It should be appreciated that the length of the first leg may be higher than, or shorter than, the length of the second leg.

In operation, the tufting machine's control system reads the vector commands and their associated functions and parameters, and generates control signals for the tufting machine's various motors and actuators to effect tufting of the desired geometry defined by vectors, with the specified pile attributes; such as cut or loop, which stitch length, what pile height, etc.

When the tufting machine's control system reads from the design file a command to set a parameter value which it can change automatically, it does so without requiring input from a human operator. When the controller reads a command which requires manual intervention, the machine automatically stops, and alerts the human operator that manual intervention is needed, displays on the controller screen which parameter value(s) in the pile specification or yarn specification must be changed, and to which value, and waits for the operator to make the required adjustments, and press the Go button again.

Since the vectors have magnitude and direction they generally define a two-dimensional motion of the tufting needle across the backing fabric between each cycle of the tufting mechanism. The vectors are typically long in relation to the stitch length, in which case many adjacent tufts spaced at the stitch length are produced along the vector path at the same pile height. In three dimensional tufting the vectors are typically around the same length as the stitches so that, if desired, a different pile height can be defined for each vector and hence the stitch, or stitches, formed when tufting along that vector. Sequences of tuft vectors are tufted in a continuous path.

When a Move command is encountered the needle reciprocating motion is ceased with the needle in the fully retracted position, and the head lifted. In the case of loop pile, the cutter is then activated once and then deactivated again before the XY mechanism is moved to the start point of the next tuft vector.

Advantageously, by using a tufting gun in accordance with the invention, one is able to tuft along a line of tufting (whether filling a shape or outlining a shape) where the pile heights are varying under control to form different pile heights along the way. Moreover, the pile height is able to be varied on a tuft by tuft basis under control of the design instructions to produce a controlled three dimensional profile of the change in pile height. This is not possible using a traditional hand tufting gun for instance, Hofmann™ or Hartleb™, each of which are limited to tufting along an outline at a constant pile height.

It will be appreciated by persons skilled in the art that numerous variations and/or modifications may be made to the invention as shown in the specific embodiments without departing from the scope of the invention as broadly described. The present embodiments are, therefore, to be considered in all respects as illustrative and not restrictive.

We claim:

1. A tufting machine comprising:

a tufting head translatable within said tufting machine in X- and Y-directions with respect to backing fabric by means of a movement system, which tufting head comprises a tufting mechanism having a cyclic mode of operation;

a hollow needle mounted in the tufting mechanism that is moveable relative to a cooperating foot in a reciprocating manner to insert a tuft of yarn into backing fabric in each cycle;

a yarn supply mechanism mounted in the tufting mechanism and operable to supply a length of yarn to the hollow needle in each cycle; and a yarn cutter mounted in the tufting head that is selectively operable to cut the length of yarn in selected cycles to produce loop or cut pile; and a computer-operated motion control system adapted to read a machine-readable tufting design pattern comprising a series of vectors and associated control codes and, in response thereto, to generate signals to drive the tufting head (a) to operate the tufting mechanism and reciprocate the hollow needle to insert tufts into backing fabric; (b) to operate the movement system and move the needle across a two-dimensional plane defined by said X- and Y-directions while inserting tufts in accordance with the vectors; (c) to lift and lower the foot in accordance with respective control codes; (d) to selectively operate the yarn cutter in accordance with respective control codes; and (e) to operate the yarn supply mechanism to selectively provide different lengths of yarn in different cycles in accordance with respective control codes, and so to individually vary the pile height of both cut and loop tufts;

wherein the yarn supply mechanism comprises a yarn feed motor;

a yarn feed roller arranged to be rotatably driven by the yarn feed motor; and a controller to receive signals from the computer-operated motion control system indicative of the length of yarn for a given tuft and in response to determine the speed of revolution of the yarn feed motor; and wherein the yarn feed motor is a stepper motor driven in an open loop configuration.

2. The tufting machine according to claim 1, wherein the yarn feed motor is a servo-controlled motor driven in a closed loop configuration.

3. The tufting machine according to claim 1, wherein the yarn supply mechanism further comprises an idle feed roller arranged adjacent to the yarn feed roller.

4. The tufting machine according to according to claim 3, wherein the yarn supply mechanism further comprises a first yarn guide device disposed upstream of the yarn supply mechanism.

5. The tufting machine according to claim 4, wherein the yarn supply mechanism further comprises a second yarn guide device disposed downstream of the yarn supply mechanism.

6. A tufting machine comprising:

a tufting head translatable within said tufting machine in X- and Y-directions with respect to backing fabric by means of a movement system, which tufting head comprises a tufting mechanism having a cyclic mode of operation;

a hollow needle mounted in the tufting mechanism that is moveable relative to a cooperating foot in a reciprocating manner to insert a tuft of yarn into backing fabric in each cycle;

a yarn supply mechanism mounted in the tufting mechanism and operable to supply a length of yarn to the hollow needle in each cycle; and a yarn cutter mounted in the tufting head that is selectively operable to cut the length of yarn in selected cycles to produce loop or cut pile; and a computer-operated motion control system adapted to read a machine-readable tufting design pattern comprising a series of vectors and associated control codes and, in response thereto, to generate signals to drive the tufting head (a) to operate the tufting mechanism and reciprocate the hollow needle to insert tufts into backing fabric; (b) to operate the movement system and move the needle across a two-dimensional plane defined by said X- and Y-directions while inserting tufts in accordance with the vectors; (c) to lift and lower the foot in accordance with respective control codes; (d) to selectively operate the yarn cutter in accordance with respective control codes; and (e) to operate the yarn supply mechanism to selectively provide different lengths of yarn in different cycles in accordance with respective control codes, and so to individually vary the pile height of both cut and loop tufts;

wherein the yarn supply mechanism comprises a yarn feed motor;

a yarn feed roller arranged to be rotatably driven by the yarn feed motor; and a controller to receive signals from the computer-operated motion control system indicative of the length of yarn for a given tuft and in response to determine the speed of revolution of the yarn feed motor; and wherein the tufting machine further comprises a sensor associated with the yarn supply mechanism to detect an absence of yarn when tufting.

7. The tufting machine according to claim 6, wherein the tufting head uses compressed air to transport the yarn through the hollow needle and into the backing fabric.

8. The tufting machine according to claim 1, wherein the tufting head uses a forked blade within the needle to transport the yarn through the hollow needle and into the backing fabric.

9. A tufting machine comprising:

a tufting head translatable within said tufting machine in X- and Y-directions with respect to backing fabric by means of a movement system, which tufting head comprises a tufting mechanism having a cyclic mode of operation;

a hollow needle mounted in the tufting mechanism that is moveable relative to a cooperating foot in a reciprocating manner to insert a tuft of yarn into backing fabric in each cycle;

a yarn supply mechanism mounted in the tufting mechanism and operable to supply a length of yarn to the hollow needle in each cycle; and a yarn cutter mounted in the tufting head that is selectively operable to cut the length of yarn in selected cycles to produce loop or cut pile; and a computer-operated motion control system adapted to read a machine-readable tufting design pattern comprising a series of vectors and associated control codes and, in response thereto, to generate signals to drive the tufting head (a) to operate the tufting mechanism and reciprocate the hollow needle to insert tufts into backing fabric; (b) to operate the movement system and move the needle across a two-dimensional plane defined by said X- and Y-directions while inserting tufts in accordance with the vectors; (c) to lift and lower the foot in accordance with respective control codes; (d) to selectively operate the yarn cutter in accordance with respective control codes; and (e) to operate the yarn supply mechanism to selectively provide different lengths of yarn in different cycles in accordance with respective control codes, and so to individually vary the pile height of both cut and loop tufts;

wherein the cutter is operable to cycle in every tufting cycle, but the cutter is moved between a cutting position where the yarn is cut each cycle and another position in which the yarn is not cut.

10. A tufting machine comprising:

a tufting head translatable within said tufting machine in X- and Y-directions with respect to backing fabric by means of a movement system, which tufting head comprises a tufting mechanism having a cyclic mode of operation;

a hollow needle mounted in the tufting mechanism that is moveable relative to a cooperating foot in a reciprocating manner to insert a tuft of yarn into backing fabric in each cycle;

a yarn supply mechanism mounted in the tufting mechanism and operable to supply a length of yarn to the hollow needle in each cycle; and a yarn cutter mounted in the tufting head that is selectively operable to cut the length of yarn in selected cycles to produce loop or cut pile; and a computer-operated motion control system adapted to read a machine-readable tufting design pattern comprising a series of vectors and associated control codes and, in response thereto, to generate signals to drive the tufting head (a) to operate the tufting mechanism and reciprocate the hollow needle to insert tufts into backing fabric; (b) to operate the movement system and move the needle across a two-dimensional plane defined by said X- and Y-directions while inserting tufts in accordance with the vectors; (c) to lift and lower the foot in accordance with respective control codes; (d) to selectively operate the yarn cutter in accordance with respective control codes; and (e) to operate the yarn supply mechanism to selectively provide different lengths of yarn in different cycles in accordance with respective control codes, and so to individually vary the pile height of both cut and loop tufts;

wherein the cutter is selectively rendered operable by being engaged to move through its cutting cycle or selectively rendered inoperable by being disengaged and stationary during selected tufting cycles.

11. The tufting machine according to claim 1, wherein the control system is operable to read tufting design patterns comprising a series of vectors and associated control codes, including one or more parameters selected from the list consisting of: Stitch Length; Pile Height, Cut Pile; Loop Pile; Raise Foot or Tufting Head; Lower Foot or Tufting Head; Cut Yarn; Enable Yarn Cutter; Disable Yarn Cutter; Change Colour.

12. The tufting machine according to claim 1, wherein the tufting needle is mounted in the tufting mechanism in a manner that allows it to be rotated freely in either direction about its axis.

13. A tufting machine comprising:

a tufting head translatable within said tufting machine in X- and Y-directions with respect to backing fabric by means of a movement system, which tufting head comprises a tufting mechanism having a cyclic mode of operation;

a hollow needle mounted in the tufting mechanism that is moveable relative to a cooperating foot in a reciprocating manner to insert a tuft of yarn into backing fabric in each cycle;

a yarn supply mechanism mounted in the tufting mechanism and operable to supply a length of yarn to the hollow needle in each cycle; and a yarn cutter mounted in the tufting head that is selectively operable to cut the length of yarn in selected cycles to produce loop or cut pile; and a computer-operated motion control system adapted to read a machine-readable tufting design pattern comprising a series of vectors and associated control codes and, in response thereto, to generate signals to drive the tufting head (a) to operate the tufting mechanism and reciprocate the hollow needle to insert tufts into backing fabric; (b) to operate the movement system and move the needle across a two-dimensional plane defined by said X- and Y-directions while inserting tufts in accordance with the vectors; (c) to lift and lower the foot in accordance with respective control codes; (d) to selectively operate the yarn cutter in accordance with respective control codes; and (e) to operate the yarn supply mechanism to selectively provide different lengths of yarn in different cycles in accordance with respective control codes, and so to individually vary the pile height of both cut and loop tufts;

wherein the yarn supply mechanism comprises a yarn feed motor, which is a servo-controlled motor driven in a closed loop configuration;

a driven yarn feed roller and an idle feed roller arranged adjacent to the driven yarn feed roller;

a first yarn guide device disposed upstream of the yarn supply mechanism; and a second yarn guide device disposed downstream of the yarn supply mechanism; and wherein the tufting machine further comprises a sensor associated with the yarn supply mechanism to detect an absence of yarn when tufting.

14. The tufting machine according to claim 13, wherein the tufting head uses compressed air to transport the yarn through the hollow needle and into the backing fabric.

* * * * *